US007261395B2

(12) United States Patent
Beak

(10) Patent No.: US 7,261,395 B2
(45) Date of Patent: Aug. 28, 2007

(54) INKJET PRINT HEAD CHIP AND INKJET PRINT HEAD USING SAME

(75) Inventor: O-hyun Beak, Suwon (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 246 days.

(21) Appl. No.: 10/694,995

(22) Filed: Oct. 29, 2003

(65) Prior Publication Data

US 2004/0119788 A1 Jun. 24, 2004

(30) Foreign Application Priority Data

Dec. 18, 2002 (KR) ..... 10-2002-0081467

(51) Int. Cl.
*B41J 2/05* (2006.01)

(52) U.S. Cl. ..... 347/58; 347/59

(58) Field of Classification Search ..... 347/48, 347/58, 59, 63, 65, 61
See application file for complete search history.

(56) References Cited

U.S. PATENT DOCUMENTS 5,159,353 A * 10/1992 Fasen et al. ..... 347/59
5,774,148 A * 6/1998 Cornell et al. ..... 347/59
6,273,544 B1 * 8/2001 Silverbrook ..... 347/20

* cited by examiner

*Primary Examiner*—An H. Do
(74) *Attorney, Agent, or Firm*—Staas & Halsey LLP

(57) ABSTRACT

An inkjet print head chip usable in an inkjet print head includes a semiconductor substrate having plural switching devices formed therein, plural heaters provided on upper sides of the switching devices and activated by the plural switching devices to heat ink, and metal wiring layers formed between the plural heaters and the switching devices which externally radiate some of the heat generated from the plural heaters.

47 Claims, 10 Drawing Sheets

INKJET PRINT HEAD CHIP AND INKJET PRINT HEAD USING SAME

CROSS-REFERENCE TO RELATED APPLICATIONS

This application claims the benefit of Korean Application No. 2002-81467, filed Dec. 18, 2002, in the Korean Intellectual Property Office, the disclosure of which is incorporated herein by reference.

BACKGROUND OF THE INVENTION

1. Field of the Invention

The present invention relates to a bubble jet-type inkjet print head chip, and more particularly, to an inkjet print head chip in which heaters are mounted to heat ink, and an ink-jet print head using same.

2. Description of the Related Art

An inkjet printer is any printer that fires extremely small droplets of ink onto media to create an image. Different types of inkjet printers form droplets of ink in different ways.

One of the most common techniques used to form droplets is the bubble jet. In a bubble jet printer, tiny heaters create heat, and this heat vaporizes ink to create a bubble in a substantially bounded volume of ink. The bubble expands and increases the pressure of the volume of ink. The pressure increase, in turn, causes droplets to form and to be ejected or fired through nozzles in the print head.

The heaters of a bubble jet printer are generally formed by a conventional semiconductor manufacturing process. On a semiconductor substrate such as a silicon wafer etc., insulation layers are formed, heaters are deposited, and patterns are formed. Then, connection electrodes are formed, and insulation layers for insulating the upper sides of the heaters and ink are deposited to complete the formation of the heaters.

The insulation layers formed under and above the heaters serve multiple functions. The lower insulation layers underneath the heaters block the loss of heat generated by the heaters through the silicon substrate, and electrically insulate the semiconductor silicon and the heaters. The upper insulation layers above the heaters electrically insulate the heaters and ink, prevent the heaters from corrosion resulting from chemical reactions with corrosive ink, and protect the heaters from damage caused by cavitation shocks occurring when ink bubbles collapse. Various substances may be used to form the upper and lower insulation layers so long as they have physical properties satisfying the above requirements. Further, the substances for the upper and lower insulation layers can be manufactured into the layers through a semiconductor manufacturing process, and have excellent junction properties between layers.

FIG. 1 illustrates a structure of a conventional inkjet print head chip constructed in consideration of the above requirements and conditions.

In FIG. 1, NPN transistors, which drive heaters, are formed on a substrate through a conventional semiconductor manufacturing process. In one NPN transistor, the collector regions 2, 4, 7, and 11 completely surround the emitter region 10 and the base regions 5 and 8. Further, an insulation layer 13 of $SiO_2$ film is formed over the NPN transistor through a thermal oxidation process, over which a thermal accumulation layer 14 of silicon oxide film is deposited. Thereafter, a heater 15 and an electrode layer 16 are formed in order before a protection layer 17 is formed. A nozzle plate 19 having ink nozzle holes is provided to cover the top of the print head chip. The thermal accumulation layer 14 functions as a lower or underneath insulation layer insulating the electrodes 12 of the transistor and the electrodes 16 of the heater 15. The protection layer 17 functions as an upper or over insulation layer insulating the electrodes of the heater from one another.

The lower insulation layer underneath the heater cuts off heat radiated when the ink is heated by the heater to maximize the supply of the heater heat to ink, and, thereafter, externally radiates the heat remaining in the heater after firing or ejecting ink before returning to its initial state. Therefore, the lower insulation layer carries out the contradictory functions of insulating the lower side or underside when the heater is heating ink and externally radiating any remaining heat from the heater after heating.

While the lower insulation layer of $SiO_2$ used as a heat accumulation layer has excellent radiation properties, it has limited heat insulating characteristics. Therefore, to achieve acceptable insulation performance, it is necessary to increase the thickness of the insulation layer. However, increasing the thickness also decreases the cooling time. A shortened cooling time makes it difficult to enhance the operation frequency of the heater, that is, the firing or ejecting frequency of the inkjet print head.

Further, in case of the bubble jet-type inkjet print heads, ink viscosity increases as the ambient temperature of ink is lowered, which occasionally causes ink not to be fired or ejected. In winter, for example, as the temperature of an office reaches about 15° C., the ink viscosity increases to a level that printing is not performed on the first one or two sheets of paper at the start of a print job.

In order to solve this problem, it is necessary to pre-heat ink to a certain temperature when the ambient temperature of ink is lowered. To accomplish this pre-heating of the ink, a conventional inkjet print head is provided with an extra heater. When activated, the extra heater heats the entire head chip to which the heater is mounted to over 30° C. However, such a method heats the entire inkjet print head chip to pre-heat ink over a certain temperature, which causes the consumption of much energy for the heating and the transistors in the inkjet print head chip may have malfunctions due to the heat.

SUMMARY OF THE INVENTION

The present invention has been devised to solve the above and/or other problems in the related art, so it is an aspect of the present invention to provide an inkjet print head chip having a structure that maximizes the transfer of heat from heaters to ink and to externally radiate the heat remaining in the heaters rapidly after heating.

Further, it is an another aspect of the present invention to provide an inkjet print head chip that pre-heats, with less heat, only the ink surrounding the heaters when pre-heating for the optimal conditions of ink firing.

Additional aspects and/or advantages of the invention will be set forth in part in the description which follows and, in part, will be obvious from the description, or may be learned by practice of the invention.

According to one aspect of the invention, there is provided an inkjet print head chip used for an inkjet print head for firing ink droplets by using bubbles occurring upon heating ink. The chip includes a semiconductor substrate having plural switching devices formed therein; plural heaters provided on the upper sides of the switching devices, and activated by the plural switching devices to heat ink; and metal wiring layers formed between the plural heaters and the switching devices, and externally radiating the heat generated from the plural heaters.

The metal wiring layers may be connected to heat-radiating parts. Further, the heat-radiating parts and the heating parts each may be provided on both sides of the plural heaters, the number of respective parts being two.

The heaters may be formed of TiN, and the metal wiring layers may be formed of aluminum (Al).

According to another aspect of the present invention, there is provided an inkjet print head chip used for an inkjet print head for firing ink droplets by using bubbles occurring upon heating ink. The chip includes a semiconductor substrate; a plurality of MOSFETs formed on the semiconductor substrate; wiring layers for applying a signal to the plurality of MOSFETs; a first insulation layer formed on the wiring layers; a plurality of heaters formed on the first insulation layer, and activated by the MOSFETs to heat ink; metal wiring layers formed in the first insulation layer underneath the plurality of heaters and externally radiating the heat generated from the plurality of heaters; and a second insulation layer formed on the plurality of heaters to prevent the plurality of heaters from coming in contact with ink.

The metal wiring layers may be connected to heat-radiating parts, and heating parting may be further connected to the metal wiring layers. Further, the heat-radiating parts and the heating parts may both be provided on both sides of the plural heaters, the number of respective parts being two.

The heaters may be formed of TiN, and the metal wiring layers may be formed of aluminum (Al). Further, the first insulation layer may be formed of two layers, an upper layer on which the metal wiring layers are mounted is formed of $SiO_2$ and a lower layer is formed of BPSG. Furthermore, the second insulation layer may be formed of SiN.

According to yet another aspect of the invention, there is provided an inkjet print head chip used for an inkjet print head for firing ink droplets by using bubbles occurring upon heating ink. The chip includes a semiconductor substrate; a plurality of MOSFETs formed on the semiconductor substrate; metal wiring layers for applying a signal to the plurality of MOSFETs; a first insulation layer formed on the metal wiring layers; a plurality of heaters formed on the first insulation layer, and activated by the MOSFETs to heat ink; metal wiring layers formed in the first insulation layer underneath the plurality of heaters, and externally radiating heat generated the plurality of heaters; a second insulation layer formed on the plurality of heaters and preventing the plurality of heaters from coming in contact with ink; and a shock-blocking layer formed on the second insulation layer and preventing shocks occurring when the bubbles collapse.

The metal wiring layers may be connected to heat-radiating parts provided outside the plural heaters, and heating parts may also be connected to the metal wiring layers. Further, the shock-blocking layer is formed of two layers, the upper layer of which is formed of TiN, and the lower layer of which is formed of Ti.

Accordingly, the inkjet print head chip may be manufactured in a general semiconductor manufacturing process for manufacturing CMOSFETs, maximize the transfer of the heat of the heaters to ink in case of heating ink, and externally radiate the heat remaining in the heaters rapidly after heating ink.

Further, the inkjet print head chip may directly heat only the heater portions in case of pre-heating ink for the optimal ink-firing conditions, to thereby consume less energy and improve the pre-heating efficiency.

According to yet another aspect of the present invention, there is provided an ink-jet print head chip. The inkjet print head chip includes: one or more heater arrays; one or more metal wiring layers disposed beneath the one or more arrays of heaters, the number of metal wiring layers being equal to the number of heater arrays; one or more heat radiating parts connected to the one or more metal wiring layers which dissipate heat absorbed by the metal wiring layers; and one or more heating parts connected to the one or more metal wiring layers which heat the metal wiring layers.

According to yet another aspect of the present invention, there is provided an ink-jet print head chip. The inkjet print head chip includes: an ink heating section which heats a volume of ink to form bubbles in the ink when activated; and a heat transfer section which absorbs residual heat from the ink heating section after the ink heating section is deactivated and transfers the absorbed residual heat to a heat sink and transfers heat generated by the ink pre-heating section to the ink proximate to the ink heating section so as to pre-heat the ink proximate to the ink heating section.

According to yet another aspect of the present invention, there is provided an ink-jet print head chip. The inkjet print head chip includes ink heaters which heat a volume of ink to form bubbles in the ink when activated; and an ink pre-heating section having heating parts and metal wiring layers disposed under the ink heaters. The heat from the heating parts is transferred directly to the ink through the metal wiring layers underneath the heaters to pre-heated the ink and thus maintain an ink firing quality of the inkjet print head.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
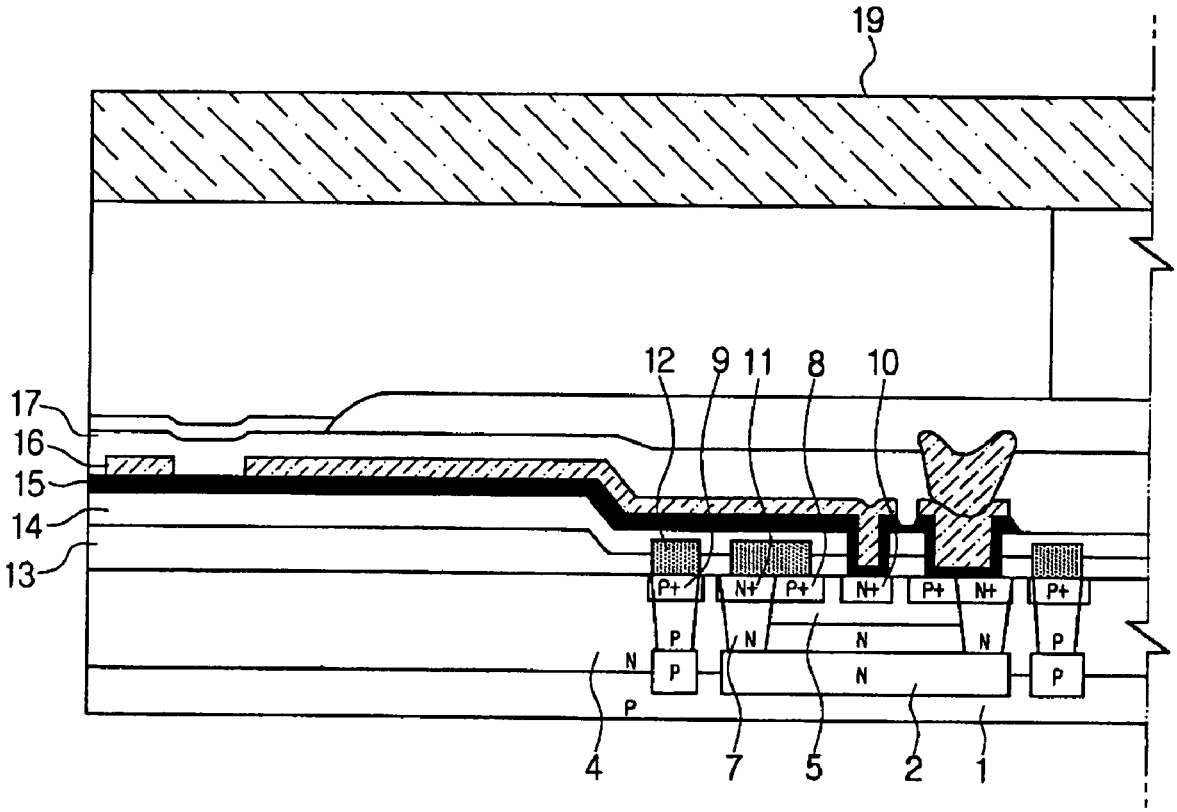
FIG. 1 PRIOR ART
FIG. 1 is a cross-sectioned view showing a structure of a conventional inkjet print head chip.

Reference will now be made in detail to the present preferred embodiments of the present invention, examples of which are illustrated in the accompanying drawings, wherein like reference numerals refer to the like elements throughout. The embodiments are described below in order to explain the present invention by referring to the figures.

Hereinafter, descriptions will be made of an inkjet print head chip according to an embodiment of the present invention with reference to the accompanying drawings.

Figure 2:
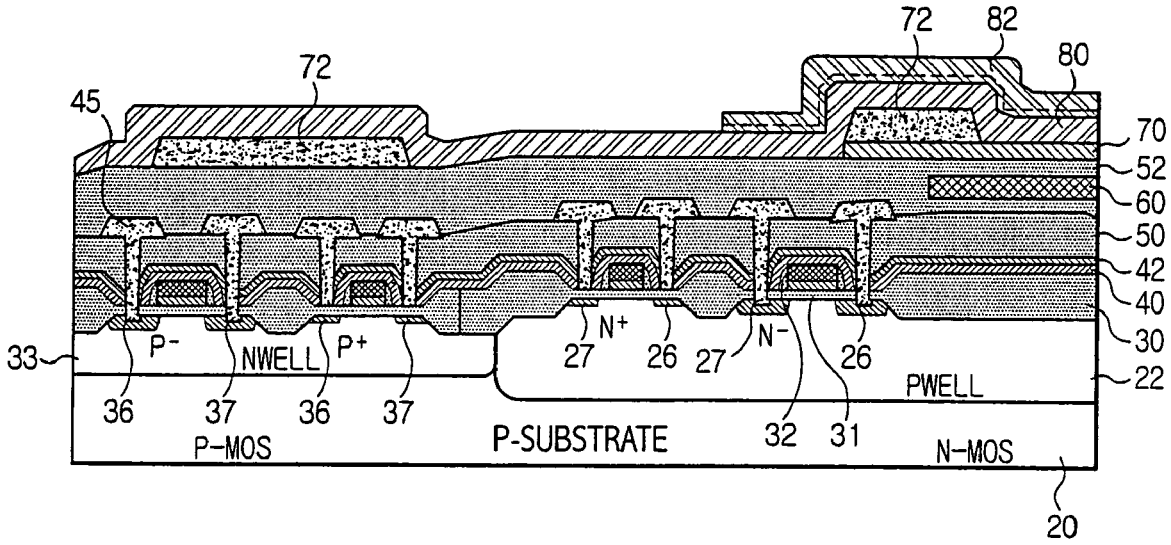
FIG. 2 is a cross-sectional view showing a structure of an inkjet print head chip according to an embodiment of the present invention.
Figure 3:
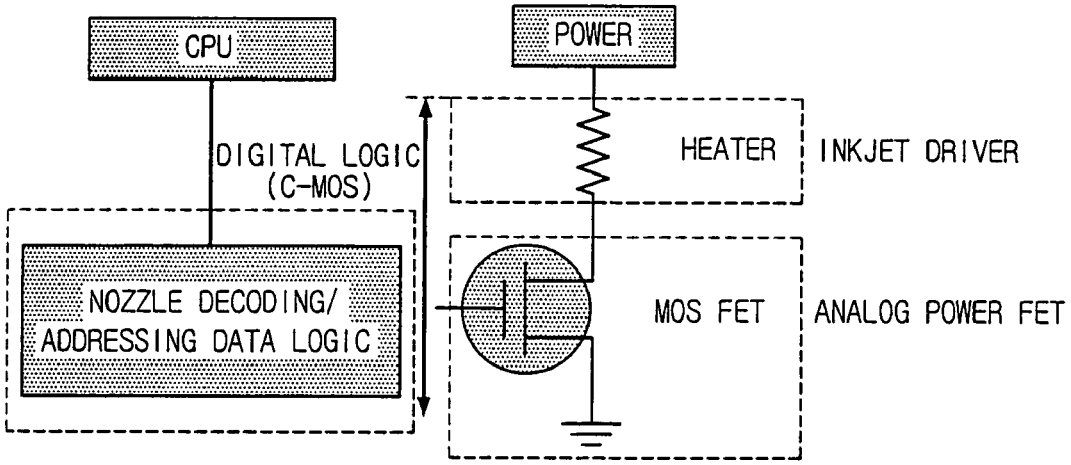
FIG. 3 is a view showing a driving circuit for the inkjet print head chip of FIG. 2.

FIG. 2 shows an inkjet print head chip according to an embodiment of the present invention, wherein the structure of a heater is provided in a CMOSFET. FIG. 3 is a view showing a driving circuit for driving the inkjet print head chip of FIG. 2.

Reference number 20 denotes a semiconductor substrate (p-type for the present embodiment), 22 a PWELL, 26 a source, 27 a drain, 31 a gate oxide, and 32 a gate poly, all of which form an NMOSFET. Reference number 33 denotes an NWELL, 36 a drain, 37 a source, 31 a gate oxide, and 32 a gate poly, all of which form a PMOSFET. Further, reference numeral 30 denotes field oxide insulating devices. Reference numerals 40, 42, and 50 denote insulating MOSFETs, a high temperature oxide (HTO) layer, an SiN layer, and a BPSG layer, respectively. Reference numeral 45 denotes primary metal wirings connecting respective drains and sources, and 52 a PE oxide layer for insulating wirings. The PE oxide layer 52 serves as a first insulation layer for preventing the transfer of heat generated by a heater 70 to the MOSFETs and externally radiated through the semiconductor substrate 20.

Reference numeral 70 denotes a heater for heating ink, 72 heater wirings through which electric current flows to the heater 70, 80 a second insulation layer for insulating the heater 70 and the heater wirings 72, 82 a shock-blocking layer formed on a portion the second insulation layer 80 comes in contact with ink, and for protecting the heater 70 from shocks due to the cavitation occurring when ink bubbles collapse. The heater 70 is formed of TiN having an excellent junction force between thin layers, and the second insulation layer 80 is formed of SiN. Further, the shock-blocking layer 82 is formed with two layers, the upper layer of the two layers in direct contact with ink is formed of TiN, and the lower layer of the same is formed of Ti. The TiN is stable in the presence of ink as a substance having excellent corrosion resistance and chemical resistance, and has resistance to surface damage caused by shocks occurring when ink bubbles collapse due to its hardness and is susceptible to breaks due to a strong fragility property so that it is difficult to absorb shocks. However, Ti is a ductile substance so that it can absorb shocks. Accordingly, if a Ti layer is formed underneath the TiN layer, an ideal structure can be obtained that is both stable in the presence of ink as well as shock absorbent so as to absorb shocks that occur when ink bubbles collapse.

Figure 4:
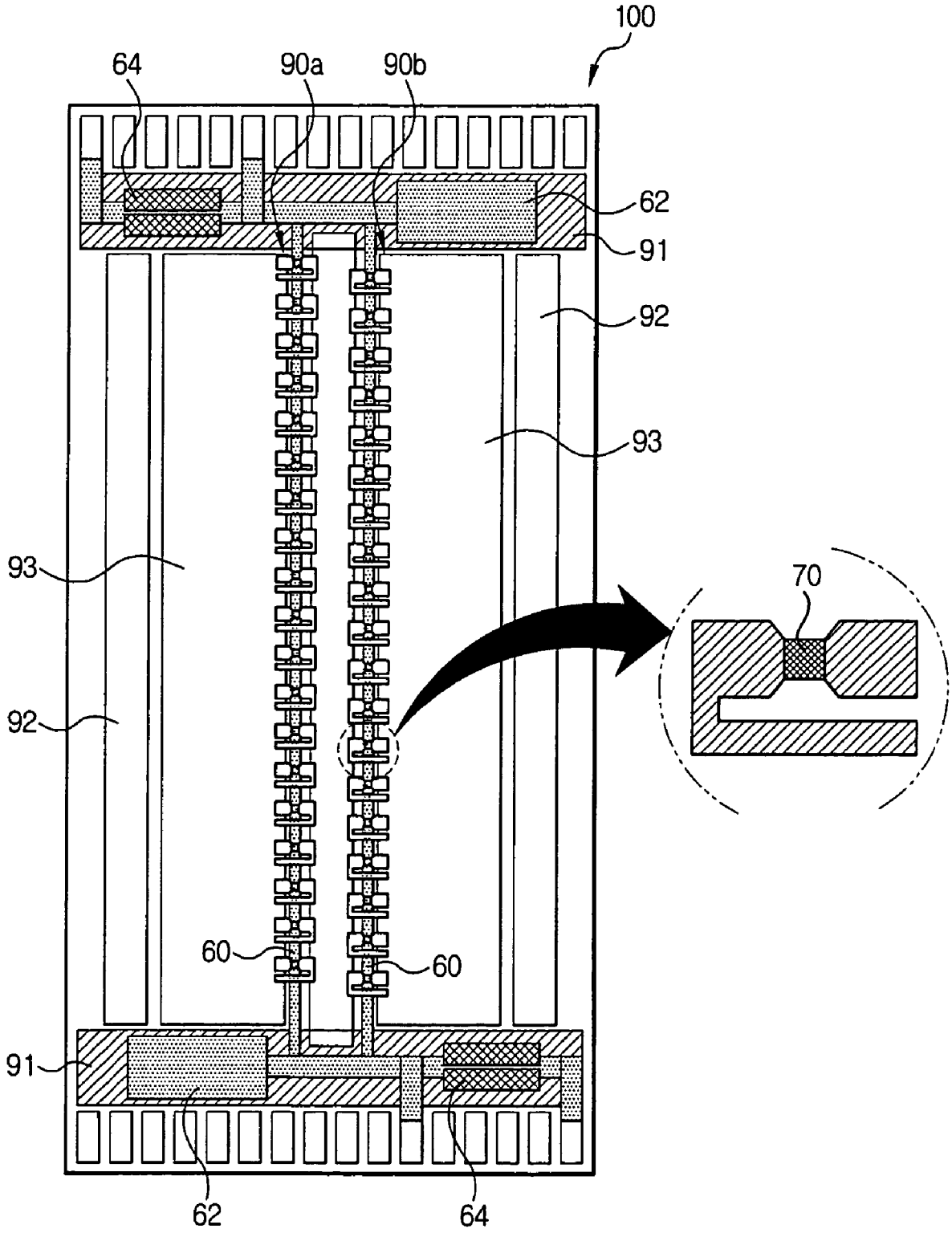
FIG. 4 is a plan view showing an arrangement of metal wiring layers, heat-radiating parts, and heating parts for the inkjet print head chip of FIG. 2 according to an embodiment of the present invention.

Reference number 60 denotes metal wiring layers which are positioned underneath the heater 70 and provided in the PE oxide layer 52 forming the upper layer of the first insulation layer. The metal wiring layers 60 are formed of aluminum (Al) or an Al alloy. The metal wiring layers 60 may have a different arrangement depending upon an arrangement of plural heaters 70. FIG. 4 illustrates such metal wiring layers 60.

Hereinafter, a process for manufacturing an inkjet print head chip with the structure as above will be described with reference to FIG. 5A to FIG. 5U. Some of the basic manufacturing operations are the same as the operations of manufacturing general CMOSFETs, so detailed descriptions of such operations are omitted.

Figure 5A:
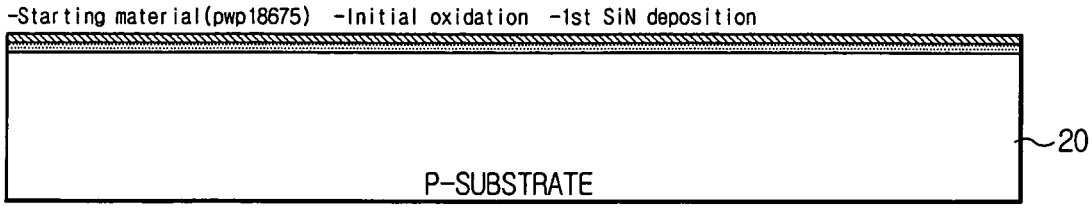
FIG. 5A to FIG. 5U are cross-sectional views for showing in order a process for manufacturing the inkjet print head chip of FIG. 2.
Figure 5B:
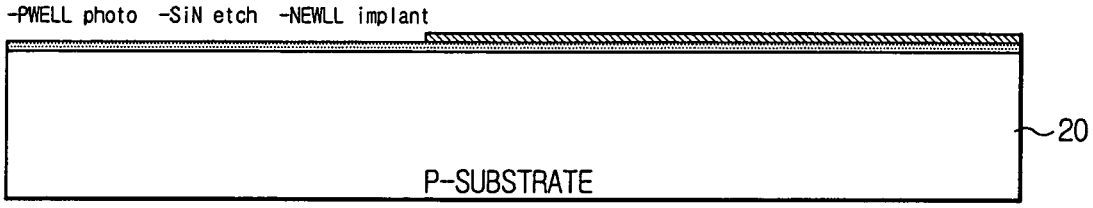
Figure 5C:
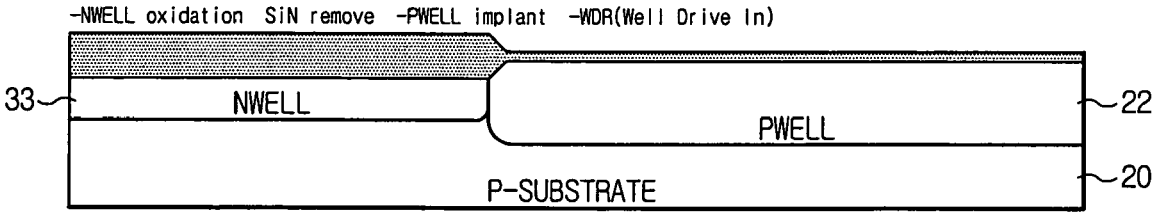
Figure 5D:
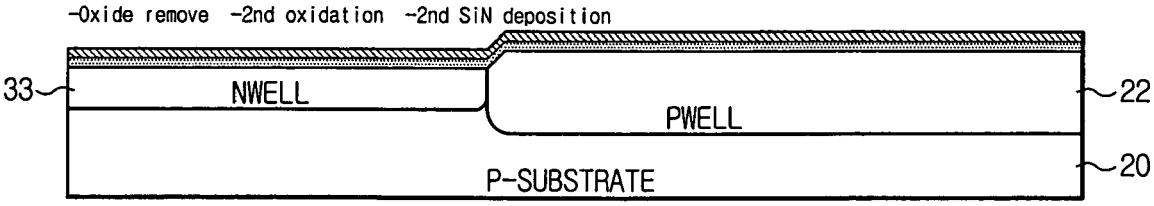
Figure 5E:
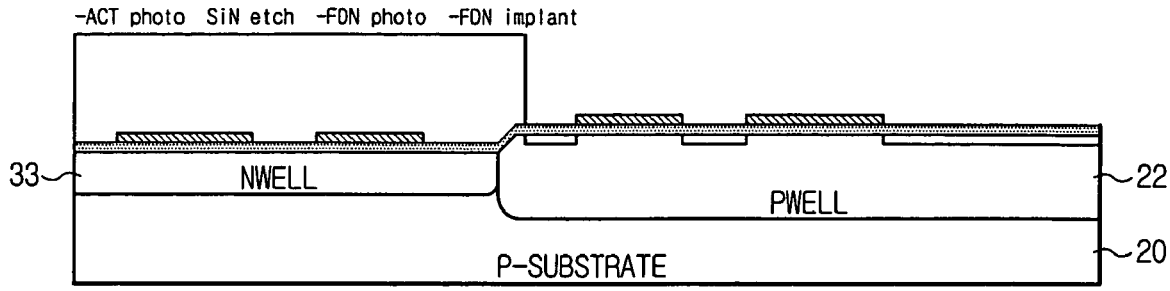
Figure 5F:
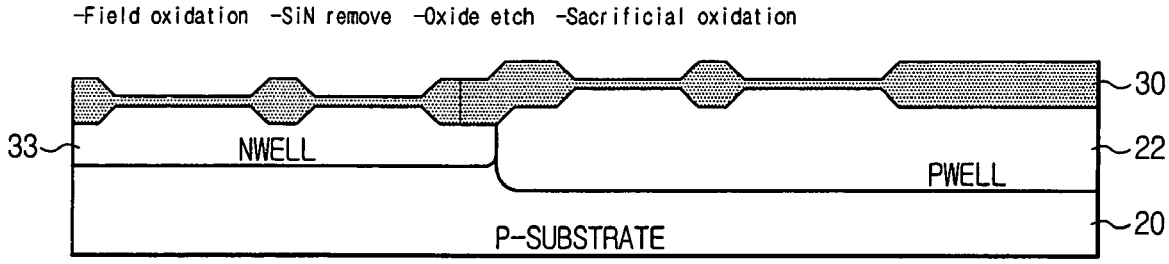
Figure 5G:
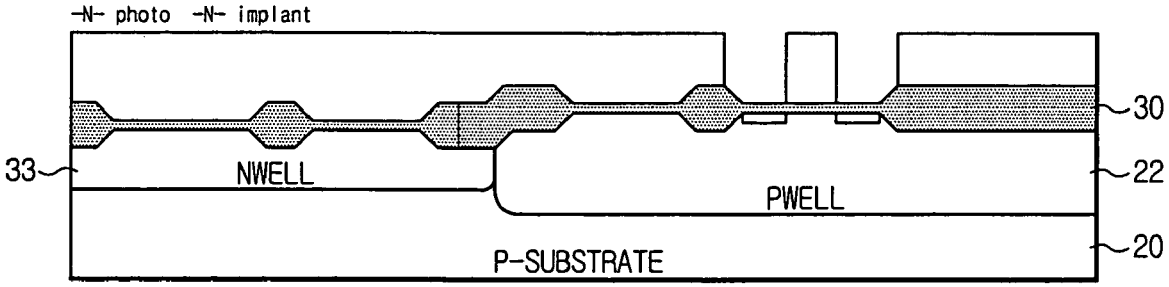
Figure 5H:
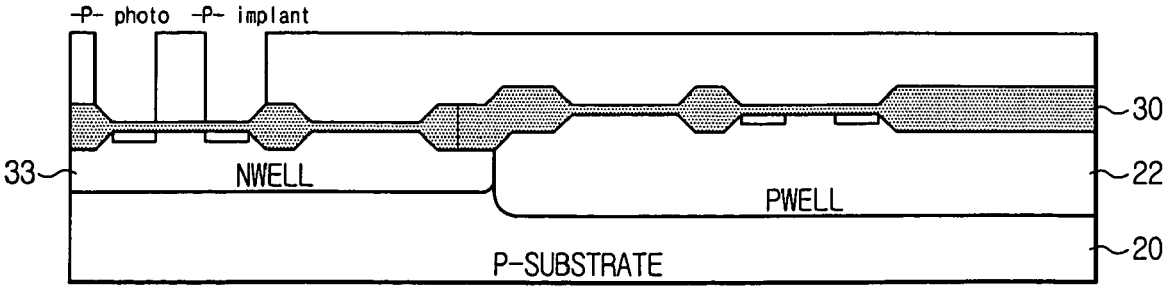
Figure 5I:
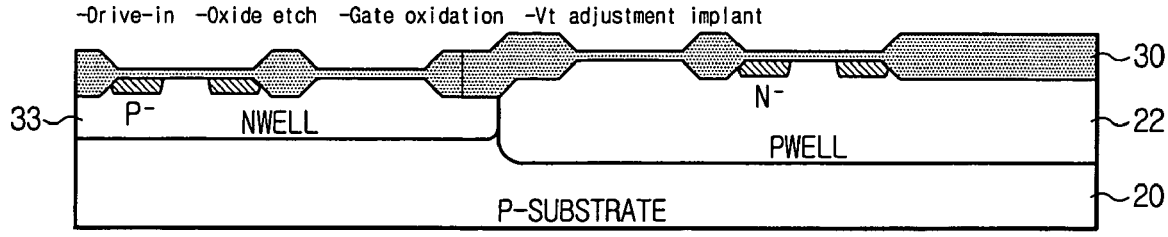
Figure 5J:
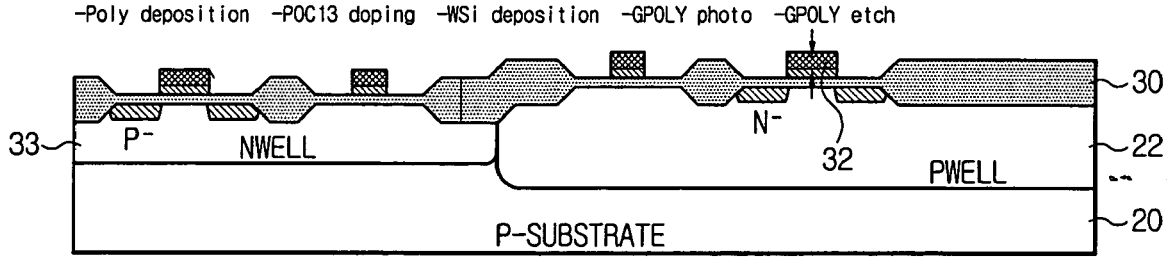
Figure 5K:
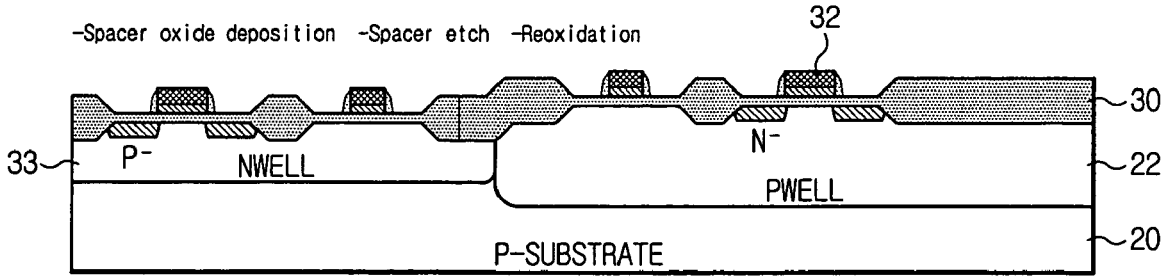
Figure 5L:
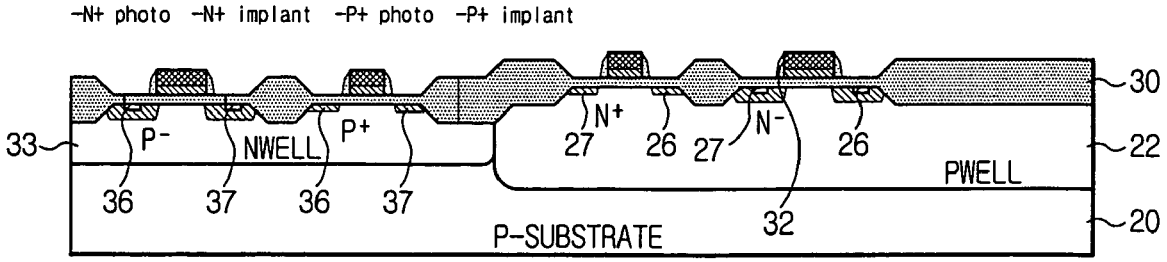

First, ions are doped into regions formed on the semiconductor substrate 20 through a photolithography operation, and the PWELL 22 and the NWELL 33 are implanted through a Drive-in operation (refer to FIGS. 5A to 5C). Subsequently, an oxide layer is formed again, a photolithography operation is implemented in the active regions, and a field oxide layer 30 is formed through a sacrificial oxidation operation (refer to FIG. 5D to FIG. 5F). The field oxide layer 30 is formed for underneath insulation portions in which heaters 70 are formed later. Thereafter, with respect to the active regions, the channels and the gate poly 32 are formed through an ion doping operation into the portions for the drains 36 and 27 and the sources 37 and 26 of the respective P- and N-type transistors and the Drive-in operation, and an oxide layer is deposited, to thereby complete the MOSFETs (refer to FIG. 5G to FIG. 5L).

Figure 5M:
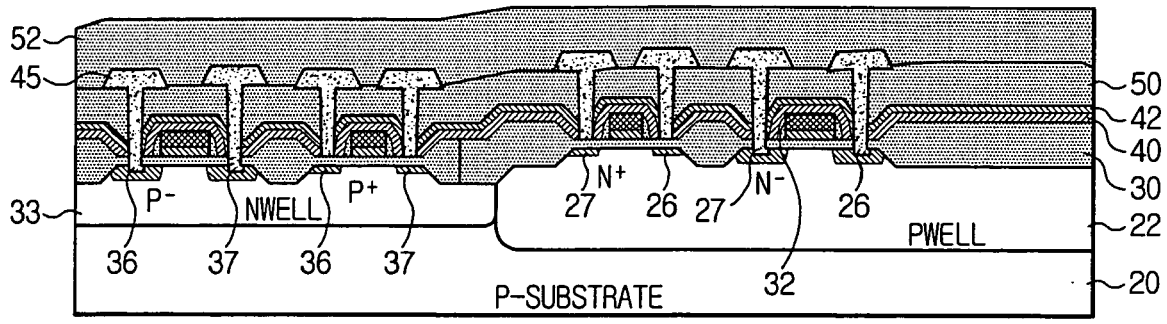
Figure 5N:
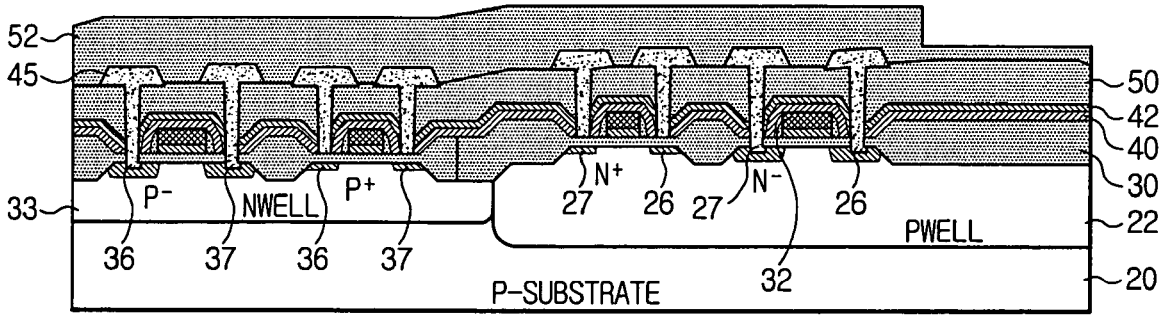
Figure 5O:
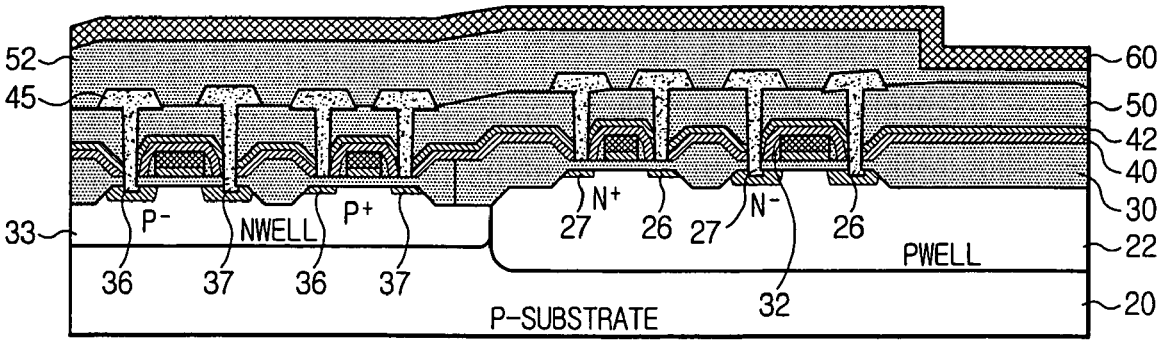
Figure 5P:
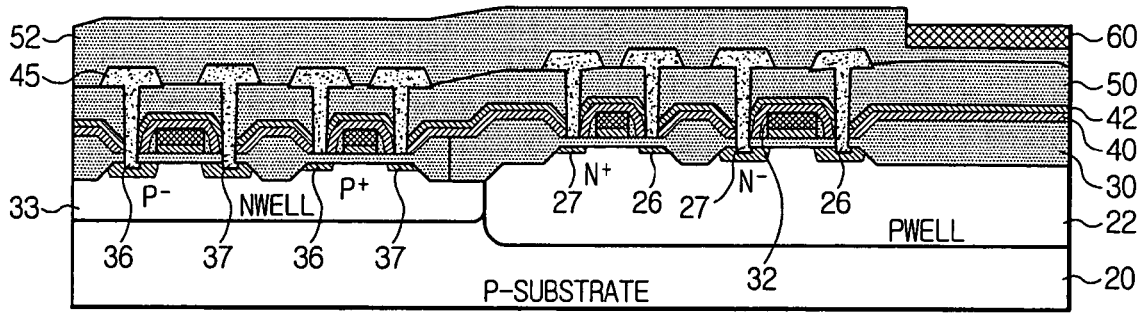
Figure 5Q:
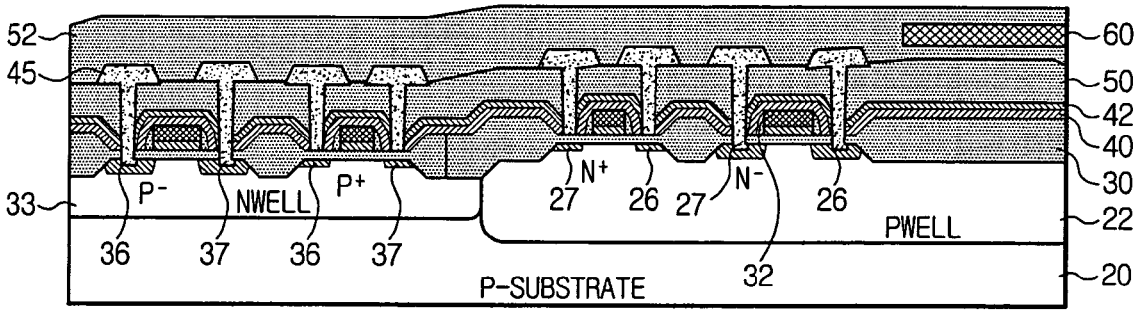
Figure 5R:
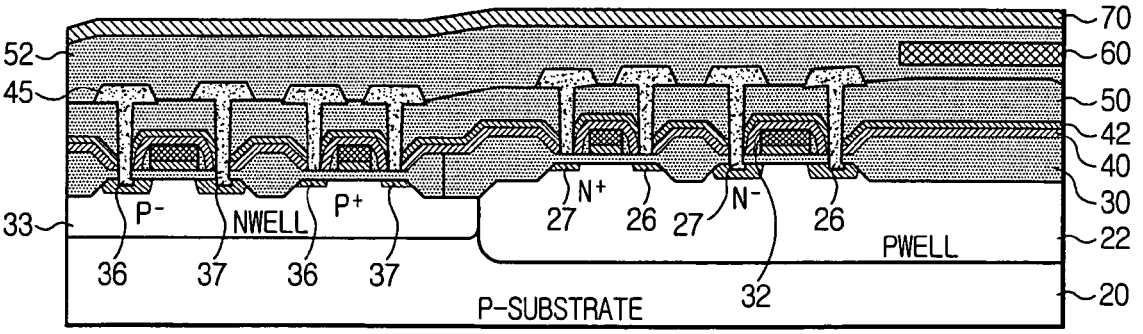
Figure 5S:
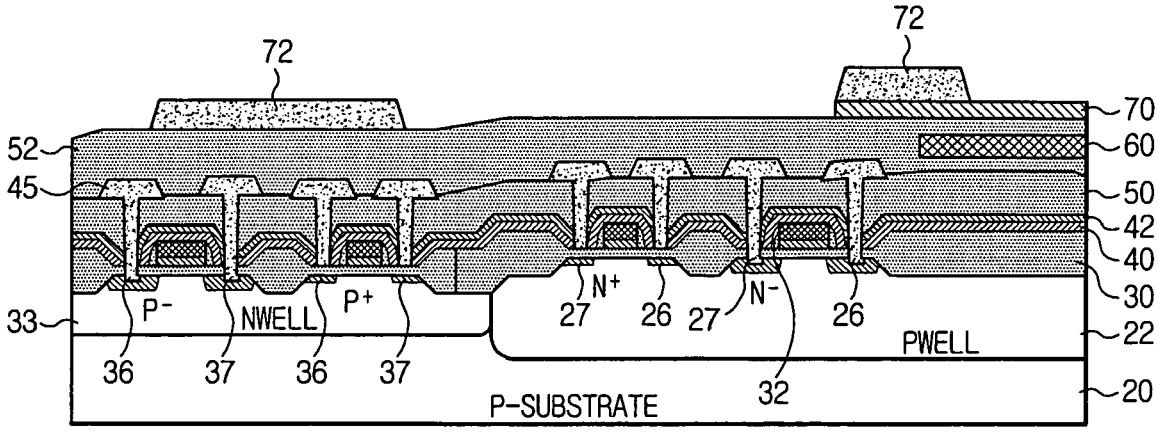
Figure 5T:
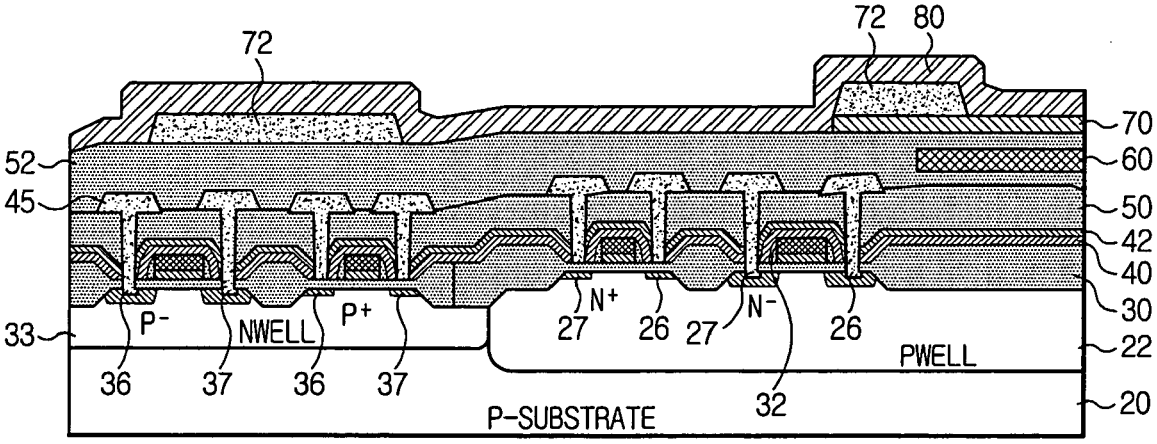
Figure 5U:
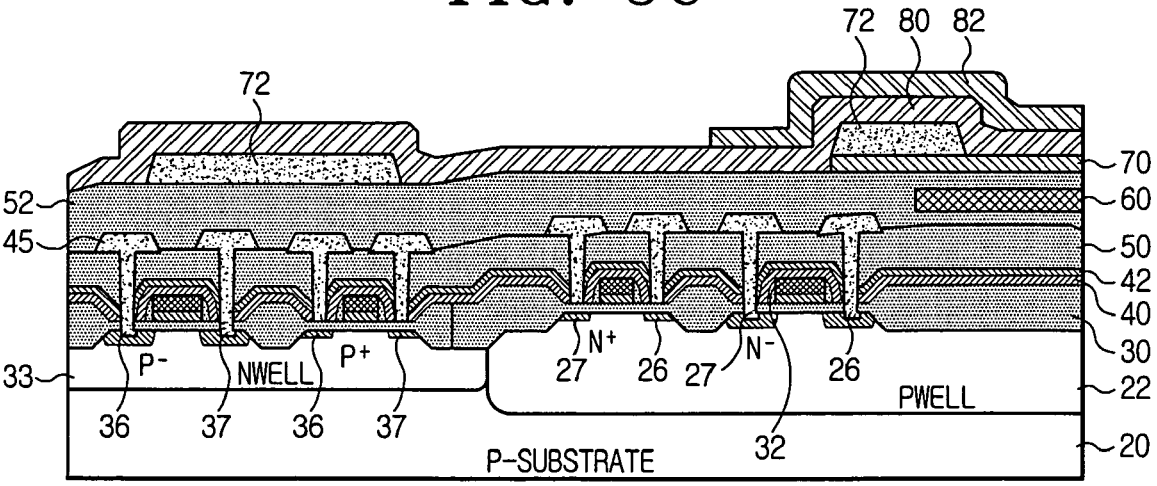

Further, for good insulation, HTO 40, SiN 42, and BPSG 50 are deposited in order to form an insulation layer. Thereafter, the insulation layer of the portions of the drains 36 and 27 and the sources 37 and 26 is cut off through the photolithograph operation, a primary metal 45 is deposited therein to form wirings, and a PE oxide layer 52 is formed to insulate the wirings (refer to FIG. 5M). Subsequently, the PE oxide layer 52 underneath a portion on which the heater 70 is formed is cut off at a certain depth through the photolithograph operations, and a metal layer of aluminum or aluminum alloy is deposited over all of the PE oxide layer 52 (refer to FIG. 5N to FIG. 5O). Thereafter, the portion except for the cut-off portion at a certain depth is etched and another PE oxide layer 52 is deposited to form the metal wiring layers 60 (refer to FIGS. 5P and 5Q). Next, the heater substance of TiN is deposited all over the PE oxide layer 52, and the TiN layer is etched except for a portion over and corresponding to the metal wiring layers 60 to form the heater 70. Thereafter, a secondary metal 72 is deposited, and wirings for supplying electric current to the metal wiring layers 60 are formed through the photolithography operation (refer to FIG. 5R and FIG. 5S). The TiN used as the heater 70 is a substance employed to improve the contact between the metal wirings and active region or between insulation layers during the MOSFET process and the substance has an excellent junction force between thin layers. SiN is deposited over all of the upper portions of the heater 70 and the secondary metals 72 to complete the insulation (refer to FIG. 5T). Further, Ti/TiN are continuously deposited on the upper portion of the heater 70 coming in contact with ink to form the shock-blocking layer 82, to thereby prevent the corrosion of the heater 70 due to ink and the damage to the heater 70 due to the cavitation occurring when ink bubbles collapse (refer to FIG. 5U).

FIG. 4 is a plan view for showing an inkjet print head chip according to an embodiment of the present invention.

Referring to FIG. 4, the metal wiring layers 60 are formed in two lines formed in parallel underneath two arrays 90*a* and 90*b* of plural heaters, on both ends of which heat-radiating parts 62 and the heating parts 64 are provided. The two lines of metal wiring layers 60 are disposed underneath the two arrays 90*a* and 90*b* of plural heaters to absorb the residual heat of the heaters 70 and to transfer the heat generated from the heating parts 64 to the heaters 70 directly. Further, the heat-radiating parts 62 are formed to have as great of a surface area as possible so that the heat transferred from the heaters 70 can be externally radiated with ease. The heating parts are sorts of resistance bodies like the plural heaters 70, and are used to raise the temperature of the heaters 70 to a certain temperature when the temperature of the heaters 70 is lowered below a certain temperature. The metal wiring layers 60 are formed of aluminum or an aluminum alloy having good heat transfer properties.

Reference number 91 denotes a digital logic part for controlling the heaters 70 according to the commands of a controller (not shown), 92 an address part for transferring a signal from the digital logic part 91 to the MOSFETs controlling the heaters 70, and 93 MOSFETs connected to the plural heaters 70 one to one to control the electric current flowing to each of the heaters 70 according to the signal of the digital logic part 91. Analog power FETs of large capacity are mainly used for the MOSFETs controlling the current flow of the heaters 70, in general.

Descriptions will be made as below on the process of the transfer of the heat generated from the heaters 70 in the inkjet print head chip 100 having the above structure.

First, in view of a cross-sectioned structure underneath the heaters 70 of the ink-jet print head chip 100 according to an embodiment of the present invention, the semiconductor substrate 20, PE oxide layers of $SiO_2$40, SiN 42, BPSG 50, $SiO_2$52, metal wiring layers 60, and $SiO_2$52 are formed in order from the bottom. Most of the layers under the heaters 70 function as insulators except for the metal wiring layers 60. Accordingly, at the time of 1 μs during which the heaters 70 are heated, the heat generated from the heaters 70 is used to heat ink (not shown) over the heaters 70 rather than flowing toward the semiconductor substrate 20. However, after heating the heaters 70, the residual heat of the heaters 70 is not transferred to the ink due to ink bubbles, but is instead transferred to the metal wiring layers 60 positioned underneath the heaters 70. The residual heat of the heaters 70 transferred to the metal wiring layers 60 is transferred to the heat radiating parts 62 along the metal wiring layers 60 disposed as shown in FIG. 4 so that the heat is radiated out of the inkjet print head chip 100. Thus, the heat radiating parts 62 function as a heat sink to dissipate the residual heat. In operation, since the residual heat of the heaters 70 is radiated through the metal wiring layers 60 of aluminum having a good heat conductivity, the heaters 70 are rapidly cooled to the initial state. Accordingly, the ready state for next ink firings is completed in a short time, so that the ink firing interval of an inkjet print head can be reduced.

Further, in case that a bubble jet-type inkjet printer is placed under low-temperature surroundings and ink pre-heating is necessary for normal ink firings, the heating parts 64 may be activated to generate heat. The heat generated from the heating parts 64 is rapidly transferred underneath the plural heaters 70 along the metal wiring layers 60, and then transferred to ink over the heaters 70. Thus, the low-temperature ink is pre-heated to a certain temperature so that, if the heaters 70 are activated, bubbles are normally generated by the heat of the heaters to fire ink. That is, the heat generated from the heating parts 64 is directly transferred to the ink so that the ink can be efficiently pre-heated. Accordingly, ink can be pre-heated to a certain temperature with less energy compared to a conventional method heating the entire head chip.

Figure 6:
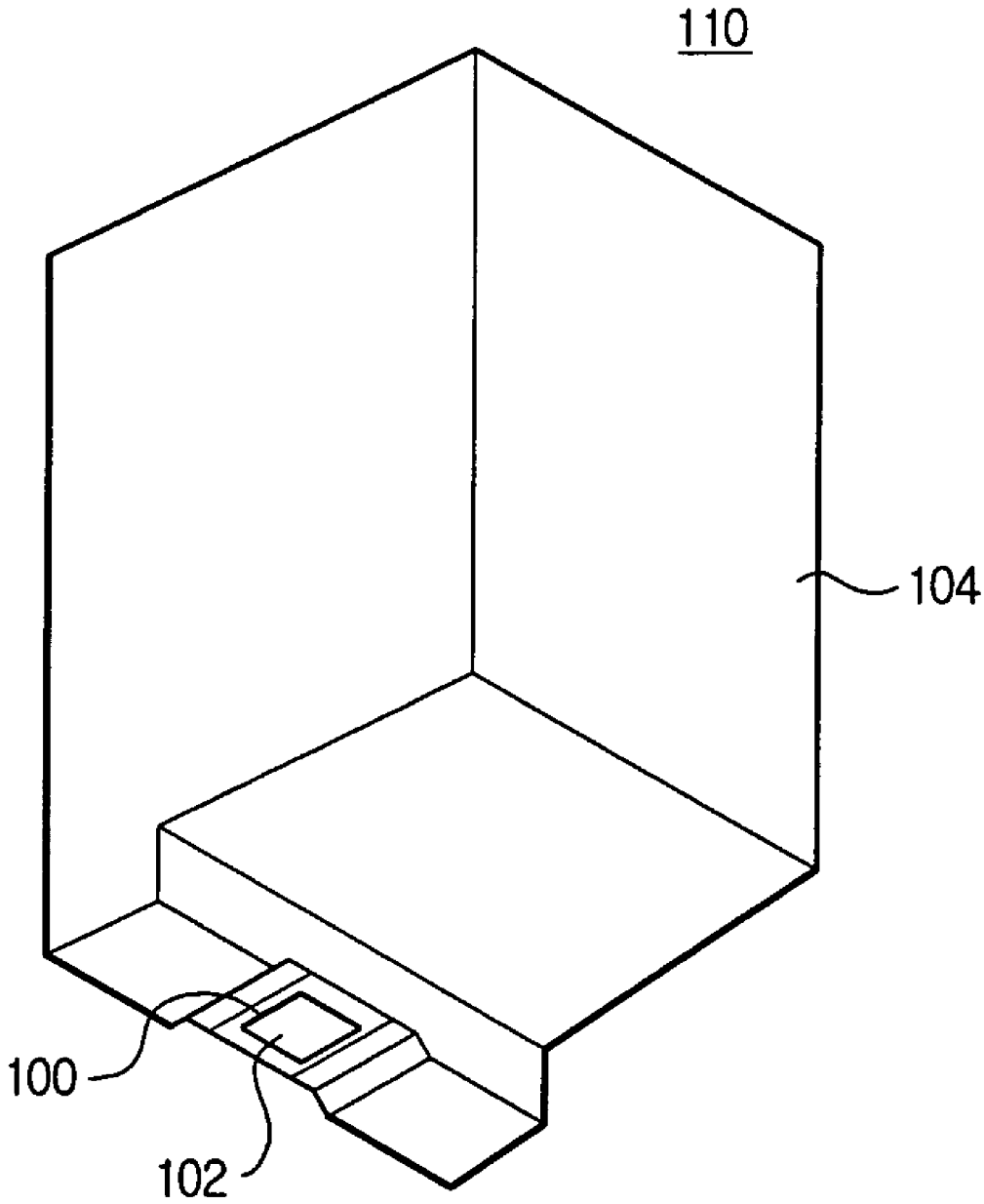
FIG. 6 is a perspective view showing an inkjet print head in which the inkjet print head chip of FIG. 2 is used according to an embodiment of the present invention.

FIG. 6 is a view for showing an inkjet print head with the inkjet print head chip according to the present invention.

The inkjet print head 110 includes a head body 104 in which ink is contained. An inkjet print head chip 100 is mounted on the bottom of the head body 104 (the side where ink is ejected), and a nozzle plate 102 is mounted on the bottom of the inkjet print head chip 100. The nozzle plate 102 is formed with nozzles matching the plural heaters 70 (shown in FIG. 4) of the inkjet print head chip 100 to fire ink when the heaters 70 are activated. Further, even though not shown, ink paths formed to plural chambers corresponding to the nozzles are formed between the nozzle plate 102 and the inkjet print head chip 100. Accordingly, as the inkjet print head chip 100 is activated with a signal of the controller of the inkjet printer, corresponding heaters 70 are activated.

If the heaters 70 (shown in FIG. 4) are activated, ink supplied to the chambers from the head body 104 is heated to generate bubbles, and the bubbles cause ink to be fired out of the chambers through the nozzles. When the heating operation of the heaters 70 is complete (i.e., the heaters deactivated), the residual heat of the heaters 70 is externally released through the metal wiring layers 60 and the heaters return to a ready state for subsequent firings.

As stated above, after ink is heated, the inkjet print head chip according to the present invention externally releases the residual heat of the heaters rapidly through the metal wiring layers so that the ink firing interval can be shortened. That is, a firing frequency of the ink-jet print head can be increased.

Further, ink is pre-heated to maintain the ink firing quality of the inkjet print head, the heat of the heating parts can be transferred directly to ink through the metal wiring layers underneath the heaters, which improves the ink-pre-heating efficiency to reduce the energy for pre-heating. Accordingly, there is no need to heat the entire inkjet print head chip to a high temperature, so that the malfunctions of the head chip can be reduced.

Although a few embodiments of the present invention have been shown and described, the present invention is not limited to the disclosed embodiments. Rather, it would be appreciated by those skilled in the art that changes and modifications may be made in this embodiment without departing from the principles and spirit of the invention, the scope of which is defined by the claims and their equivalents.

What is claimed is:

1. An inkjet print head chip usable in an inkjet print head, comprising:

a semiconductor substrate having plural switching devices formed therein;

plural heaters provided on upper sides of the switching devices and activated by the plural switching devices to heat ink;

metal wiring layers formed between the plural heaters and the switching devices which externally radiate some of the heat generated from the plural heaters; and at least one heat radiating part to which the metal wiring layers are thermally connected and disposed to be remote from the heaters.

2. The inkjet print head chip of claim 1, wherein the heaters are formed of TiN.

3. The inkjet print head chip of claim 1, wherein the metal wiring layers are formed of one of aluminum (Al) and an aluminum alloy.

4. The inkjet print head chip of claim 1, wherein the plural heaters are provided in two adjacent linear arrays.

5. The inkjet print head chip of claim 1, wherein the metal wiring layers absorb residual heat after, the heaters are deactivated to decrease an amount of the residual heat transferred to the ink and to decrease a time required for the plural heaters to return to a ready state.

6. An inkjet print head chip usable in an inkjet print head, comprising:

a semiconductor substrate having plural switching devices formed therein;

plural heaters provided on upper sides of the switching devices and activated by the plural switching devices to heat ink;

metal wiring layers formed between the plural heaters and the switching devices which externally radiate some of the heat generated from the plural heaters; and at least one heat radiating part to which the metal wiring layers are connected and which is disposed on at least one side of an area where the plural heaters are provided.

7. The inkjet print head chip of claim 6, wherein the heat radiating part is dimensioned to maximize their surface area so as to facilitate heat radiation.

8. The inkjet print head chip of claim 6, further comprising heating parts connected to the metal wiring layers and which heat the metal wiring layers.

9. The inkjet print head chip of claim 8, wherein the metal wiring layers transfer the heat generated from the heating parts to the ink surrounding the plural heaters to pre-heat the ink.

10. The inkjet print head chip of claim 8, wherein the plural heaters have two sides and two of the heat-radiating parts are respectively provided on the sides of the plural heaters.

11. An inkjet print head chip used usable in an inkjet print head, comprising:

a semiconductor substrate;

a plurality of MOSFETs formed on the semiconductor substrate;

wiring layers which apply a signal to the plurality of MOSFETs;

a first insulation layer formed on the wiring layers;

a plurality of heaters formed on the first insulation layer, and activated by the MOSFETs to heat ink;

metal wiring layers formed in the first insulation layer underneath the plurality of heaters and which externally radiates some of the heat generated by the plurality of heaters;

a second insulation layer formed on the plurality of heaters to prevent the plurality of heaters from coming into contact with the ink; and at least one heat radiating part to which the metal wiring layers are thermally connected and disposed to be remote from the heaters.

12. The inkjet print head chip of claim 11, wherein the heaters are formed of TiN.

13. The inkjet print head chip of claim 11, wherein the metal wiring layers are formed of one of aluminum (Al) and an aluminum alloy.

14. The inkjet print head chip of claim 11, wherein the first insulation layer includes two layers, an upper layer on which the metal wiring layers are mounted is formed of $SiO_2$ and a lower layer is formed of BPSG.

15. The inkjet print head chip of claim 11, wherein the second insulation layer is formed of SiN.

16. The inkjet print head chip of claim 11, wherein the plural heaters are provided in two adjacent linear arrays.

17. The inkjet print head chip of claim 11, wherein the metal wiring layers absorb residual heat after the heaters are deactivated to decrease an amount of residual heat transferred to the ink and to decrease a time required for the plural heaters to return to a ready state.

18. An inkjet print head chip used usable in an inkjet print head, comprising:

a semiconductor substrate;

a plurality of MOSFETs formed on the semiconductor substrate;

wiring layers which apply a signal to the plurality of MOSFETs;

a first insulation layer formed on the wiring layers;

a plurality of heaters formed on the first insulation layer, and activated by the MOSFETs to heat ink;

metal wiring layers formed in the first insulation layer underneath the plurality of heaters and which externally radiates some of the heat generated by the plurality of heaters;

a second insulation layer formed on the plurality of heaters to prevent the plurality of heaters from coming into contact with the ink; and at least one heat radiating part to which the metal wiring layers are connected and which is disposed on at least one side of an area where the plurality of heaters are provided.

19. The inkjet print head chip of claim 18, wherein the heat radiating part is dimensioned to maximize a surface area thereof so as to facilitate heat radiation.

20. The inkjet print head chip of claim 18, further comprising heating parts connected to the metal wiring layers and which heat the metal wiring layers.

21. The inkjet print head chip of claim 20, wherein the metal wiring layers transfer heat generated from the heating parts to the ink surrounding the plural heaters to pre-heat the ink.

22. The inkjet print head chip of claim 20, wherein the plural heaters have two sides and two of the heat-radiating parts are respectively provided on the two sides of the plural heaters.

23. An inkjet print head chip usable in an inkjet print head, comprising:

a semiconductor substrate;

a plurality of MOSFETs formed on the semiconductor substrate;

first metal wiring layers which apply a signal to the plurality of MOSFETs;

a first insulation layer formed on the metal wiring layers;

a plurality of heaters formed on the first insulation layer, and activated by the MOSFETs to heat ink;

second metal wiring layers formed in the first insulation layer underneath the plurality of heaters, and externally radiate some of the heat generated by the plurality of heaters;

a second insulation layer formed on the plurality of heaters and preventing the plurality of heaters from coming into contact with the ink;

a shock-blocking layer formed on the second insulation layer which blocks shocks occurring when the bubbles resulting from the heated ink collapse; and at least one heat radiating part to which the second metal wiring layers are thermally connected and disposed to be remote from the heaters.

24. The inkjet print head chip of claim 23, wherein the shock-blocking layer is formed of two layers, an upper layer formed of TiN, and a lower layer formed of Ti.

25. The inkjet print head chip of claim 23, wherein the first insulation layer includes two layers, an upper layer on which the metal wiring layers are mounted is formed of $SiO_2$ and a lower layer is formed of BPSG.

26. The inkjet print head chip of claim 23, wherein the second insulation layer is formed of SiN.

27. The inkjet print head chip of claim 23, wherein the plural heaters are provided in two adjacent linear arrays.

28. The inkjet print head chip of claim 23, wherein the second metal wiring layers absorb residual heat after the heaters are deactivated to decrease an amount of residual heat transferred to the ink and to decrease a time required for the plural heaters to return to a ready state.

29. The inkjet print head chip of claim 23, wherein the metal wiring layers transfer heat generated from the heating parts to ink surrounding the plural heaters to pre-heat the ink.

30. The inkjet print head chip of claim 23, wherein the plural heaters are provided in two adjacent linear arrays.

31. The inkjet print head chip of claim 23, wherein the metal wiring layers absorb residual heat after the heaters are deactivated to decrease an amount of residual heat transferred to the ink and to decrease a time required for the plural heaters to return to a ready state.

32. An inkjet print head chip usable in an inkjet print head, comprising:

a semiconductor substrate;

a plurality of MOSFETs formed on the semiconductor substrate;

first metal wiring layers which apply a signal to the plurality of MOSFETs;

a first insulation layer formed on the metal wiring layers;

a plurality of heaters formed on the first insulation layer, and activated by the MOSFETs to heat ink;

second metal wiring layers formed in the first insulation layer underneath the plurality of heaters, and externally radiate some of the heat generated by the plurality of heaters;

a second insulation layer formed on the plurality of heaters and preventing the plurality of heaters from coming into contact with the ink;

a shock-blocking layer formed on the second insulation layer which blocks shocks occurring when the bubbles resulting from the heated ink collapse; and at least one heat radiating part to which the second metal wiring layers are connected and which is disposed on at least one side of an area where the plurality of heaters are provided.

33. The inkjet print head chip of claim 32, wherein the at least one heat radiating part is dimensioned to maximize a surface area thereof so as to facilitate heat radiation.

34. The inkjet print head chip of claim 32, further comprising heating parts connected to the second metal wiring layers and which heat the second metal wiring layers.

35. The inkjet print head chip of claim 34, wherein the second metal wiring layers transfer heat generated from the heating parts to the ink surrounding the plural heaters to pre-heat the ink.

36. The inkjet print head chip of claim 34, wherein the plural heaters have two sides and two heat-radiating parts are respectively provided on the two sides of the plural heaters.

37. The inkjet print head of claim 32, further comprising heating parts connected to the metal wiring layers and which heat the metal wiring layers.

38. An inkjet print head chip, comprising one or more heater arrays;

one or more metal wiring layers disposed beneath the one or more arrays of heaters, the number of metal wiring layers being equal to the number of heater arrays;

one or more heat radiating parts connected to the one or more metal wiring layers which dissipate heat absorbed by the metal wiring layers;

one or more heating parts connected to the one or more metal wiring layers which heat the metal wiring layers; and at least one heat radiating part to which the metal wiring layers are thermally connected and disposed to be remote from the heater arrays.

39. The inkjet print head chip of claim 38, wherein the number of heat radiating parts and the number of the heating parts are the same as the number of metal wiring layers.

40. The inkjet print head chip of claim 39, wherein a heat radiating part and a heating part are connected to opposing ends of each metal wiring layer.

41. The ink jet print head chip of claim 38, further comprising a logic part which controls the heaters.

42. The inkjet print head chip of claim 41, further comprising an address part which transfers control signals from the logic part to one or more MOSFETs which control an electric current flowing to the heaters according to the control signals from the logic part.

43. The inkjet print head chip of claim 38, further comprising a shock absorbing layer disposed above the heaters to absorb shocks resulting from bubble bursts in the ink.

44. The inkjet print head chip of claim 38, wherein the one or more metal wiring layers absorb residual heat from the heaters and transfer the absorbed heat to the one or more heat radiating parts.

45. The ink jet print head chip of claim 38, wherein the one or more metal wiring layers transmit heat generated by the heating parts to ink surrounding the heaters.

46. An inkjet print head, comprising:

a head body in which ink is contained;

an inkjet print head chip mounted on a bottom of the head body and having plural heaters heating ink contained in the head body;

a nozzle plate mounted on the bottom of the inkjet print head chip and formed with plural nozzles firing ink heated by the plural heaters, wherein the inkjet print head chip comprises a semiconductor substrate having plural switching devices formed therein, and metal wiring layers formed between the plural heaters and the switching devices, which externally radiate some of the heat generated from the plural heaters, and the plural heaters provided on the upper sides of the switching devices, and activated by the plural switching devices to heat the ink; and at least one heat radiating part to which the metal wiring layers are thermally connected and disposed to be remote from the heaters.

47. An inkjet print head chip comprising:

ink heaters which heat a volume of ink to form bubbles in the ink when activated; and an ink pre-heating section having heating parts, metal wiring layers disposed under the ink heaters, and a heat radiating part thermally connected to the metal wiring layers and remote from the ink heaters, wherein heat from the heating parts is transferred directly to the ink through the metal wiring layers underneath the heaters to pre-heated the ink and thus maintain an ink firing quality of the inkjet print head.

* * * * *

UNITED STATES PATENT AND TRADEMARK OFFICE

CERTIFICATE OF CORRECTION

PATENT NO. : 7,261,395 B2
APPLICATION NO. : 10/694995
DATED : August 28, 2007
INVENTOR(S) : O-hyun Beak It is certified that error appears in the above-identified patent and that said Letters Patent is hereby corrected as shown below:

Column 8, Line 57, in Claim 5, change “after,” to --after--.

Column 9, Line 11, in Claim 8, change “claim 6,” to --claim 1,--.

Signed and Sealed this

Twenty-third Day of September, 2008

JON W. DUDAS
*Director of the United States Patent and Trademark Office*